US005582158A

United States Patent [19]

Linsmeyer

[11] Patent Number: 5,582,158

[45] Date of Patent: Dec. 10, 1996

[54] CALIPER TYPE BOW STRING RELEASE WITH FULLY ADJUSTABLE HEAD

[75] Inventor: Louis R. Linsmeyer, Hustisford, Wis.

[73] Assignee: Tru-Fire Corporation, North Fond du Lac, Wis.

[21] Appl. No.: 285,797

[22] Filed: Aug. 4, 1994

Related U.S. Application Data

[63] Continuation-in-part of Ser. No. 979,106, Nov. 20, 1992, Pat. No. 5,357,939.

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 2,488,597 | 11/1949 | Konold | 124/35.2 |
| 2,819,707 | 1/1958 | Kayfes et al. | 124/35.2 |
| 5,307,788 | 5/1994 | Peck | 124/35.2 |
| 5,318,004 | 6/1994 | Peck | 124/35.2 |
| 5,370,102 | 12/1994 | Peck | 124/35.2 |

*Primary Examiner*—John A. Ricci

*Attorney, Agent, or Firm*—Robert C. Curfiss; Mark A. Tidwell; Butler & Binion, L.L.P.

[57] ABSTRACT

A caliper type bow string release includes a rocking trigger and caliper jaws with automatic alignment and locking features, whereby movement of the string into the release mechanism engages the automatic locking mechanism and closes the release into a string retaining position until the release is fired by activation of the trigger. A complex cam surface is provided on the actuator for permitting incremental linear adjustment of the trigger force. The release head is universally adjustable relative to a wrist strap or similar mounting.

16 Claims, 2 Drawing Sheets

FIG. 3
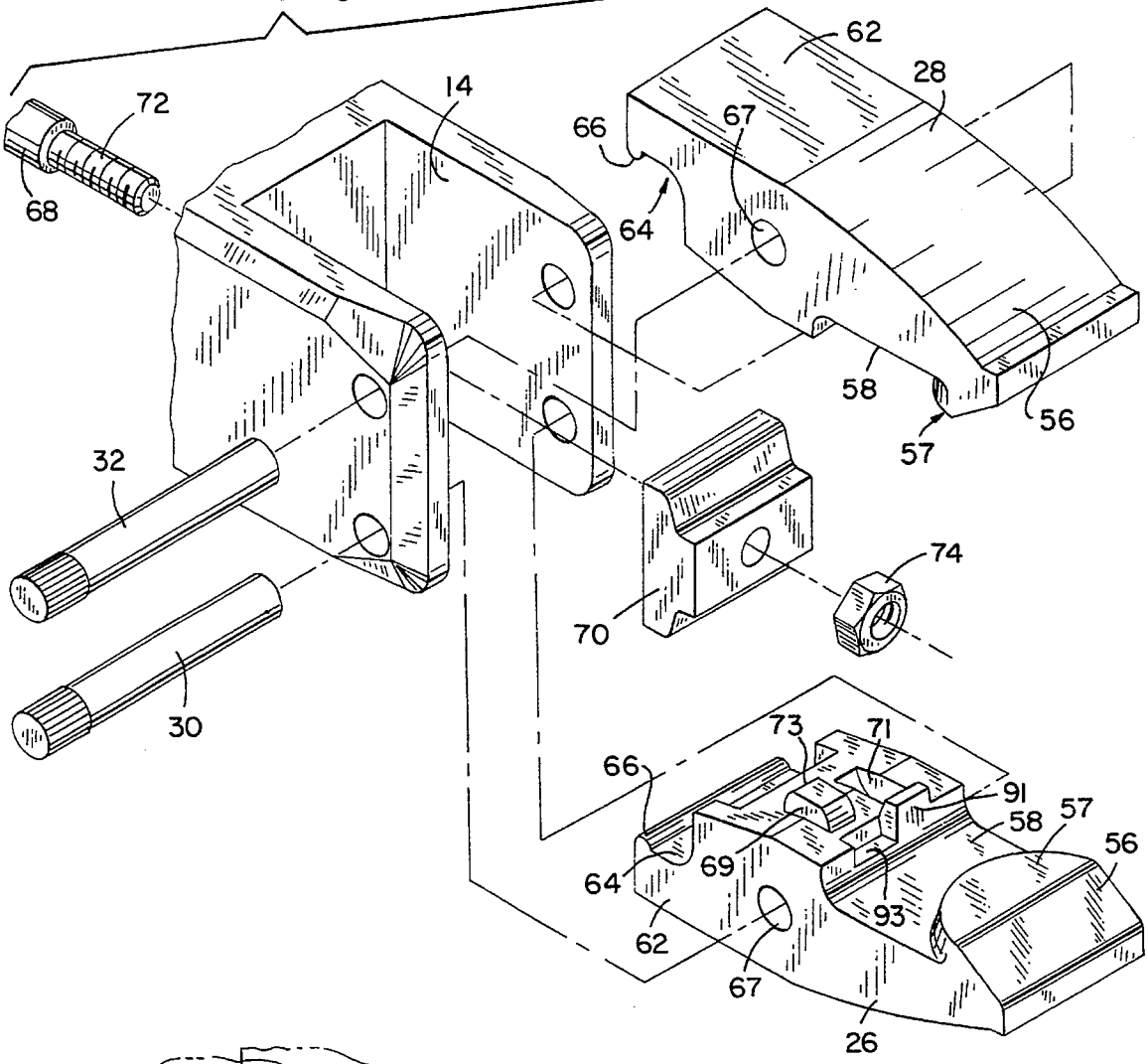
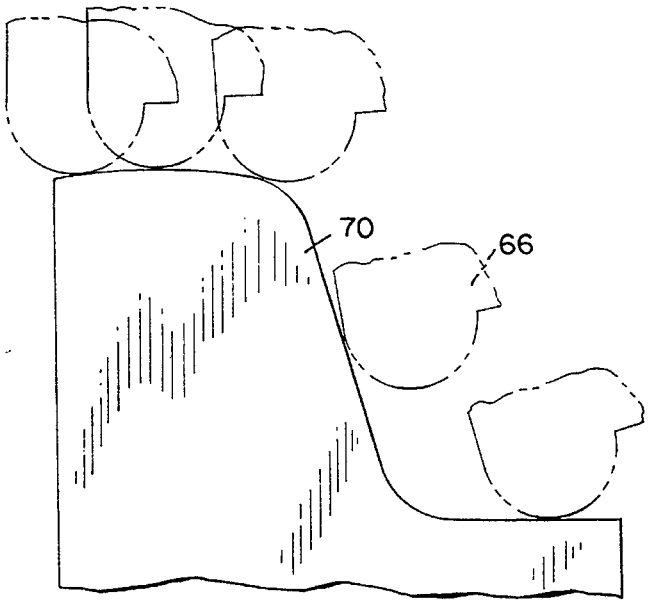
FIG. 4

CALIPER TYPE BOW STRING RELEASE WITH FULLY ADJUSTABLE HEAD

CROSS REFERENCE TO RELATED APPLICATION

This application is a continuation-in-part of application Ser. No. 07-979,106, filed Nov. 20, 1992, U.S. Pat. No. 5,357,939.

BACKGROUND OF INVENTION

1. Field of Invention

The subject invention is generally related to bow string releases of the type having a releasable sear for retaining a bow string, the sear including a pair of elements adapted for movement into and out of a closed position to retain the bow string and selectively release it. The invention is specifically directed to a caliper type bow string release having an adjustable trigger and including a head which is rotatable a full 360° and is angularly adjustable relative to the strap assembly.

2. Description of the Prior Art

Bow string releases have grown in popularity for target shooting and for hunting. A good release provides uniform release of the bow string and increases accuracy. The release is either hand held or strapped to the wrist and has a trigger which permits the archer to release the string. Typically, such devices employ a pivotable finger that engages the bow string. The finger or sear being movable to a release position for releasing the string. Releases of this type are illustrated in U.S. Pat. Nos. 4,066,060; 3,898,974; and 3,954,095.

It is also known to use ball or cylindrical elements in place of the finger to retain and release the string, wherein the elements are held by a head and retained in position by a yoke or sleeve. Devices of this type are shown in U.S. Pat. Nos. 4,403,594 and 5,263,466. While it is recognized that when the balls are separated by the tension of the string this provides minimal friction engagement and quiet release, there is still a strong preference for the caliper type jaw releases. One of the problems with the jaw releases is they are not self-locking and an independent action is required to lock the bow string in the sear mechanism after the string is released and upon reentry.

In addition, it is desirable that the release be fully adjustable relative to the hand of the archer in order to permit the release to be held in the most desirable and comfortable position. To date, most releases permit limited adjustment, but none have been designed to be fully universally adjustable. Further, most releases are designed to either more adequately accommodate a right-handed archer or a left-handed archer. In some cases, design changes have to be made in order to permit a specific configuration to be adapted from right-hand to left-hand use. While most releases accommodate such design changes, this greatly increases the manufacturing costs, increasing the ultimate end cost of the release to the user.

Therefore, there remains a need for a caliper type bow string release which is both self-locking and self-aligning. In addition, there is a need for a bow string release which is readily adaptable to either left-hand or right-hand use and would permit to universally adjust the position of the release to maximize comfort and functionality.

SUMMARY OF THE INVENTION

The subject invention is a bow string release which is specifically designed to utilize the caliper jaw type sear mechanism while providing a self-locking and self-alignment feature. In addition, the release includes a calibration system permitting incremental adjustment of the trigger force, assuring accurate, consistent and predictable adjustment. The release is also designed to equally accommodate either left-handed or right-handed use and to permit universal adjustment of fit by the archer.

The caliper jaws of the subject release are configured to operate as pivoting elements simulating ball type movement and include jaws having an interior notch area for holding the string rearwardly of the front end of the jaws, wherein pivotal motion of the jaws spreads the jaws to release the string through the forward end and from the string releasing notch. The rearward ends of the jaws are specifically designed to each include a cam follower for engaging a cam surface on a linear motion actuator which is moved in response to actuation by the trigger. The subject invention recognizes the fact that the non-linear forces in the jaw and the non-linear forces by the motion of the trigger have to be accommodated in the calibration and engagement surface in order to provide for linear, incremental adjustment of the trigger force. The calibration of the release mechanism specifically includes a non-linear, calibrated surface to account for the various forces on the release at various stages of its movement. The end result is a linear or incremental calibration adjustment mechanism which assures consistent, accurate and precise incremental adjustment of the trigger force on the release.

It is an important feature of the invention that the caliper-type jaw mechanism is self-aligning and self-locking. In the preferred embodiment, the mated jaws are identical to one another, and are in fact a common manufactured component. This greatly reduces the manufacturing costs while at the same time enhancing the design and repeatability characteristics of the release. In one embodiment, the alignment mechanism is provided by an arcuate alignment tab which is received in a concave arcuate alignment recess in the complementary mated jaw, assuring continuous contact between the two jaws at all points during their travel from the closed abutting locking position to the spread apart, release position. In addition, the jaws are provided with a string engaging self-locking tab which intercepts the string as it enters the notch area, engaging the jaw and forcing it closed as the string is properly seated in the release.

The bow string release of the subject-invention is adapted to be attached to a wrist strap in such a manner as to permit adjustment of the distance between the trigger mechanism and the strap, and to permit universal adjustment for accommodating both right handed and left handed archers. The release position may be adjusted for maximum comfort and functionality. The adjustment mechanism of the preferred embodiment permits adjustment of the position of the release relative to the strap pad and hence the palm of the archer. A sleeve extends outwardly from the palm pad and carries rotatable shaft in a tube, whereby the tube may be moved axially relative to the pad for adjusting the axial position. The release is mounted on the shaft. In the preferred embodiment, the tube is flanged outwardly for receiving a spherical end of the release assembly, permitting the release to "wobble" in the flanged tube end for permitting angular adjustment to comfort and fit. The release may also be rotated 360° relative to the strap.

It is, therefore, an object and feature of the subject invention to provide a caliper type release having a self-aligning and self-locking mechanism.

It is another object and feature of the subject invention to provide a release having an incremental adjustment system by incorporating a non-linear actuator surface to accommodate and cancel out the non-linear force increments on the various moving parts of the string release.

It is further an object of the invention to provide a bow string release mechanism which easily accommodates both left-handed and right-handed archers.

It is a further object and feature of the subject invention to provide a release which is universally adjustable for comfort, fit and functionality.

Other objects and features of the invention will be readily apparent from the accompanying detailed drawing and description.

BRIEF DESCRIPTION OF THE DRAWINGS

FIG. 3 is an exploded perspective view showing the jaw assembly of the release of the subject invention.

FIG. 4 is a diagrammatic view showing the relationship between the cam and cam follower.

DETAILED DESCRIPTION OF THE PREFERRED EMBODIMENT

Figure 1:
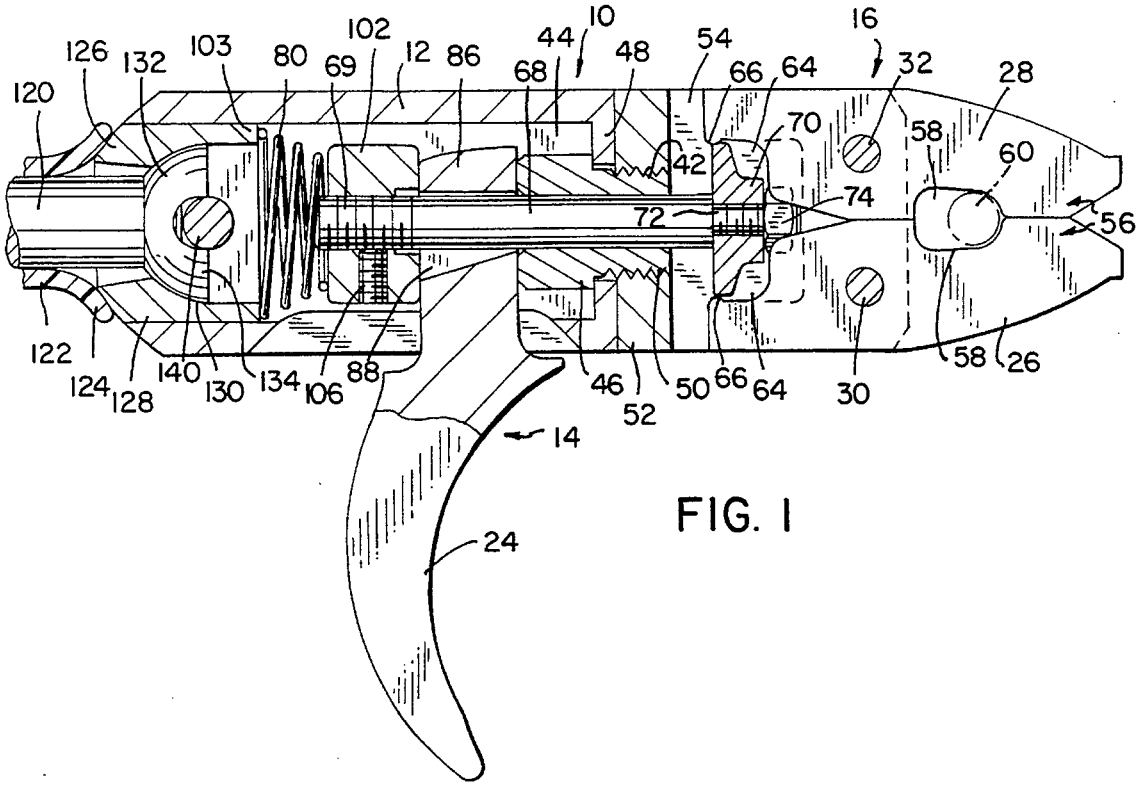
FIG. 1 is a plan view, partially in section, showing a bow string release incorporating the features of the subject invention.

The string release of the subject invention is shown in FIG. 1 and is designated generally by the numeral 10. The release includes a body or housing 12 which carries the trigger mechanism 14 and a head 16. The trigger 24 is positioned to be engaged by the index finger for releasing mechanism. The jaw mechanism 21 is mounted in the head 16. In the preferred embodiment , the jaw assembly includes a pair of jaws 26 and 28 which are pivotably mounted, as indicated by the pivot pins 30 and 32.

As is typical, the housing 12 maybe of a molded construction with two mated halves adapted to be held together, typically by threaded screws or the like. In the preferred embodiment, the head 16 is secured to an elongated, hollow shaft 42 which is carried in a receptive recess 44 in the housing. The shaft 42 includes an enlarged head end 46 which is seated against a stop wall 48 positioned in the recess 44. The right (as drawn) or opposite end 50 of the shaft is threaded for receiving a threaded coupling 52 which is secured to the head 16. Typically, a spacer 54 is provided between the head 16 and the threaded coupling 52.

Figure 2:
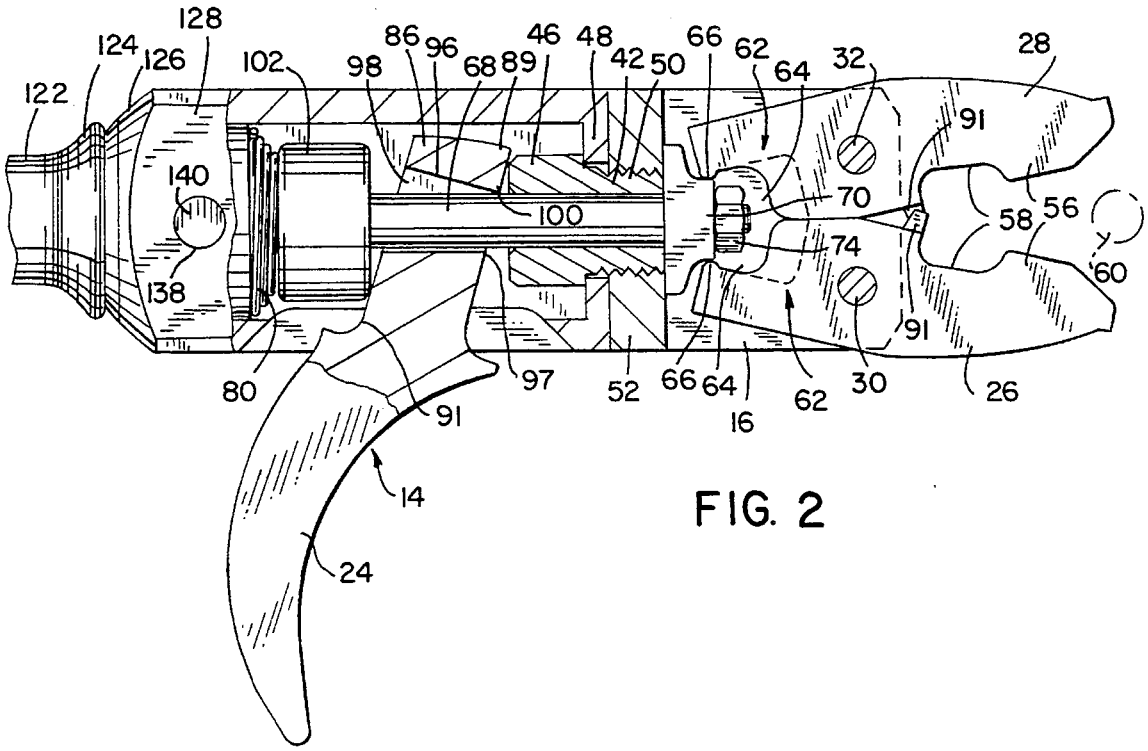
FIG. 2 is a view similar to FIG. 1, showing the release in the open, string releasing position, with the trigger in the rearward, fire mode.

The shaft 42 is rotatable in the body 12. This construction permits the head 16 to rotate 360° relative to the housing 12. The coupling 52 and head 16, respectively, are held on the rotatable shaft in the housing for defining the primary components of the bow string release. As is best seen in FIG. 2, the jaws 26 and 28 are pivotally mounted in the head 16 by pivot pins 30 and 32, respectively.

The bow string release mechanism of the type illustrated is a caliper-type release with a pair of opposed, functioning jaws 26 and 28. The forward ends 56 of the jaws are designed to close into abutting engagement with one another, as shown in FIG. 1, with a string receptive notch 58 positioned behind each forward end 56, and of a dimension large enough to accommodate a standard bow string 60, as illustrated in phantom. The rearward end 62 of each jaw includes an actuator receptive clearance or recess 64 and an actuator engaging element 66 which, in the preferred embodiment, serves as a cam follower for the cam actuator of the subject invention, as will be described.

In the embodiment illustrated, the actuator comprises an elongated actuator rod 68 which extends through the housing 12 and the axial bore hollow shaft 42. The rod 68 includes a cam actuator 70 mounted on the forward end. In the preferred embodiment, the forward end 72 of the actuator rod is of a reduced diameter and is threaded (FIG. 1), whereby the cam actuator 70 is held in position on the end of the rod by means of a threaded fastener such as, by way of example, the nut 74.

In the preferred embodiment of the invention, the trigger 14 includes an elongated stem 24 having an upper end 86 and including a through slot or channel 88 for receiving the actuator rod 68. The rear end 69 of the shaft is externally threaded for receiving an adjustable stop nut 102. As shown in FIG. 2, the trigger rocks on the rod 68, with top edge 89 engaging the enlarged end 46 of the shaft 42. As the trigger is pulled back, the engagement surface 91 of the trigger engages the stop nut 102 and pulls the actuator rod back to move the cam 70 away from the sear notch, allowing the cam followers 66 to ride along the cam surface as shown in FIG. 3, permitting the jaws 26 and 28 to open and release the string 60.

In the preferred embodiment, the upper edge 96 of the trigger channel is parallel to the axis of the actuator rod 68 when the released as closed as in FIG. 1. The lower edge 97 defines an expanding taper from front to rear. This assures that the front top edge 100 of the trigger is always in engagement with the actuator rod, permitting a smooth trigger action.

In the preferred embodiment, the stop nut 102 is tapped to be threadably received on the rod 68. This permits a fine adjustment of the axial position of the stop nut 102 relative to the rod 68 to control the trigger fire force. A set screw 106 is provided to lock the trigger engaging stop nut in position on the shaft to assure accurate and fixed adjustment of the trigger stroke. A compression spring 80 is positioned between the stop nut 102 and the rear end wall 103 of the release assembly for continuously urging the rod 68 into the forward, jaw latching position of FIG. 1. In the preferred embodiment of the invention, the trigger is specifically designed to comfortably accommodate either a left handed or right handed archer.

An important aspect of the subject invention is the cam follower and cam release actuator mechanism. Specifically, the cam 70 and cam followers 66 on the jaws 26 and 28 are designed to provide an incremental adjustment of the trigger force in relation to the adjustment of the trigger stroke by calibration of the trigger engaging stop nut 102, whereby the force required to fire the mechanism by movement of the trigger 24 is adjusted. This is an important advance over the prior art since the proportional cam mechanism permits incremental and predictable change in the force needed to operate the trigger when firing the release in a one-to-one or equal incremental relationship to change in the trigger adjustment mechanism defined by the trigger engaging nut 102 and the actuator rod 68. Also, by understanding the importance of the shape of the cam surface, specific customized adjustment features may be designed to permit different rates of change to be built into the adjustment mechanism. This has several advantages over the prior art adjustable releases. For example, for low trigger force levels say, 1 to 4 ounces, one increment of movement of the adjustment mechanism should produce an increase of one ounce of trigger force. That is, equal angular repositioning of the threaded element 102 along the shaft 68 will result in equal adjustments in the trigger force. By way of example, one turn would result in a one ounce adjustment in trigger force. This linear or incremental adjustment is accomplished by understanding that a nonlinear or proportionally cam surface 70 is required. This proportionality not only reduces the number of attempts made by trial and error to achieve a specific trigger force, it also reduces the potential for overshooting an adjustment and putting a release in a marginal or unsafe condition.

By understanding the relationship between the nonlinear or proportional cam surface 70 and the linear incremental adjustment of the trigger, it is also possible to design a calibrating mechanism utilizing progressively increasing increment rates for higher adjustments. For example, a four ounce trigger setting may be achieved using one increment per ounce change in trigger force representing 25% change in trigger force. At 20 ounces the same increment represents only a 5% change in the trigger force. If the release is adjusted for a low trigger force many adjustment increments are required in order to reach the 30 ounce range. If the increment rate is high then fewer adjustment increments are required to move from a lower force setting to a higher force setting, but the force changes at the low end of the range increment are very large. Therefore, it is desirable to have a low or flat rate of change at the low end of the range so finer adjustments can be made, while at the upper end of the range the rate of response to adjustment input should be greater. The proportional trigger mechanism of the subject invention allows any number of rates or continuously variable rates to be built in by recognizing the importance of the shape of the cam surface 70. The end result is a trigger adjustment mechanism which provides for a proportional and consistent adjustment, which is quicker and easier to use with less travel at higher trigger force levels and with a wider range of adjustment for lower trigger force levels, with predictable results.

The method of calibrating the trigger takes into consideration all of the forces encountered in the release to define a direct relationship between the trigger 24, cam 70 and the cam followers 66. By keeping the radius on the follower cam as small as possible, the contact point between the cam and the cam follower is minimized and has a minimum effect on the trigger force. The coefficient of friction between the cam and cam follower is also monitored and is, of course, determined by the material used for the cam and the jaws as well as the finish. The precise shape of the cam surface can be developed using a trial and error basis, by determining the various relationships developed for each setting of the trigger. Of course, there is a defined mathematical model for this, as well. In the preferred embodiment, the cam surface was calculated by mathematical modeling. In order to accurately determine the trigger force utilizing the calibration mechanism of the subject invention, the following relationships apply:

$$\cos C = \frac{(\cos(90 - C) \times A) + Fs((\sin(90 - C \times A) + (\sin A \times G))}{G}$$

$$\tan C = \frac{[G - FsA]}{[A + FsG]} \quad \text{when contact angle adds to load on trigger pull pin}$$

$$\tan C = \frac{[FsA + G]}{[A - FsG]} \quad \text{when contact angle subtracts to from load on trigger pull pin}$$

$$Tf = \frac{G + S}{MA}$$

where:

C=contact angle between cam and cam follower sear elements

A=two times the force on a follower

Fs=coefficient of friction static on cam and followers

G=force on trigger pull pin due to loading and Fs

S=force applied by the return spring

MA=mechanical advantage of the trigger lever

Tf=trigger force required to fire the release.

As will be noted from the above, the subject invention provides a unique, consistent and predictable mechanism and method for adjusting the trigger force for the string release utilizing the caliper type jaws, a cam surface actuator and radiused cam follower, as shown in the drawings.

The jaw configuration of the subject invention provides for automatic alignment of the jaw member and for latching the release onto a bow string and retaining it in the string retaining notch 58 by simply placing the string in the jaw and engaging the automatic mechanism. Specifically, the automatic synchronizing and latching mechanisms provide three functions, as follows:

1. jaw synchronization;
2. a reduction in the relative movement between jaws while in the latched position; and
3. a resetting means to latch the release in the latched or locked position for holding the bow string in the release.

Specifically, each jaw 26 and 28 includes a forward end 56, and abutment surface 57, a string retaining notch 58, a rearward end 62, an actuator receptive recess 64, a cam follower 66 and a pivot point defined by the through hole 67. As shown, the pivot point defined by the through hole 67 is positioned intermediately of the forward end 56 and the rearward end 62 in the central body portion of each jaw. In the illustrated embodiment, each jaw further includes an arcuate synchronizing tab 69 projecting radially outward from the center point of the pivot hole and adapted to be received in a concave arcuate recess 71 in the complementary jaw.

In the preferred embodiment, each of the jaws 26 and 28 are identical and when positioned in the abutted mated relationship shown in the drawings, the arcuate tab 69 and concave recess 71 are in an over/under position, providing a dual, over/under alignment feature between the two mated jaws 26 and 28. It will be noted that the diametric center of each arcuate tab is positioned on a straight line with the centers of the pivot points 67 when the jaws are in the closed, locked position. Where desired, the arcuate tab 69 may have a flat outer surface 73 to provide additional clearance between the jaws and facilitate fluid movement of the jaws between the latched closed position of FIG. 1 and the opened position of FIG. 2.

The arcuate synchronization tab 69 and complementary recess 71 provide synchronized movement of the two jaws when they are mounted in the head or support member 14, by assuring that they move together through the interrelationship of the tab 69 and recess 71. This provides an inexpensive synchronizing system by relieving the required tolerance limits on the pivot pins 30 and 32 and the pivot holes 67.

The jaw also includes an automatic latching feature as defined by the latch tab 91 provided on each jaw and the complementary latch receptive seat 93. In the preferred embodiment the latch tab 91 of each jaw is disposed offset from the synchronizing tab 69, to prevent movement of the jaws relative to one another when closed. As with the synchronizing tabs 69, the latch tabs 91 are positioned in an over/under relationship when the jaws are mounted in complementary mated position on the support head 14, as best seen in FIG. 2. The latching tab 91 is adapted to intercept the bow string 60 as the bow string is introduced into the notch area 58. The string 60 engages forward surface 95 of each latching tab 91 and forces the tab rearward (or to the left, as drawn), and ultimately into the position of FIG. 1. As this occurs, the rearward ends 62 of the jaws 26, 28 spread, permitting cam 70 to enter the cam receptive recess 64. This permits the spring 80 to advance the actuator rod shaft 68 forward, further advancing the cam actuator 70 into the recesses 64, whereby the cam engages the cam followers 66 and locks the jaws in abutting relationship along abutment surfaces 57 of the jaws to lock the string in the notch area 58 and retain the release in the closed, locked position.

As shown in FIGS. 1 and 2, the release 10 is secured to the mounting assembly in such a manner as to permit universal adjustment of the release relative to the mounting shaft 120. Specifically, the end of the shaft 120 is mounted in a tube 122. The shaft may be fixedly secured to the tube by any well known manner. The release end 124 of the tube 120 is flanged outwardly for receiving a spherical end 126 of the release mounting piece 128. The release mounting piece has a hollow core with a seat 130 for receiving the head 132 of a fastener 134. In the preferred embodiment, the fastener 134 is threadably engaged by the shaft 120, for holding the mounting piece on the end of tube 122.

In the preferred embodiment, the mounting piece 128 includes a pair of diametrically opposed through holes 138 (FIG. 2), for carrying a mounting post 140. The post 140 defines a pivot pin, permitting the release 10 to pivot relative to the fastener 132. In addition, the spherical end of the mounting piece 128 may "wobble" in the flanged tube end 124, permitting the release 10 to be angularly adjusted for comfort. This feature is more clearly described in my co-pending application, Ser. No. 08-285800, entitled: "Bow String Release with Continuous Wrist Strap", filed on even date herewith, and incorporated by reference herein.

While certain features and embodiments of the invention have been described in detail herein, it will be readily understood that the subject invention includes all modifications and enhancements within the scope and spirit of the following claims.

What is claimed is:

1. A bow string release mechanism having a sear assembly movable between a closed, string retaining position and an opened string releasing position, an actuator associated with the sear assembly in the closed position, the actuator responsive to a movable trigger to disengage the sear assembly and permit the sear assembly to move from the closed position to the opened, string releasing position, the sear assembly comprising:

a. a support element:

b. a pair of opposed jaws having a string retaining member and mounted on the support element for pivotal movement with at least one jaw pivoting between the opened and closed positions;

c. each pivoting jaw including an actuator engaging portion, whereby the jaws are retained in the closed position when engaged by the actuator and are free to move to the opened position when not engaged by the actuator; and d. the actuator further including a jaw engaging adjustment surface selectively movable into and out of contact with the jaws in response to movement of the actuator by the trigger, the adjustment surface being positionally adjustable for varying the required force to be applied on the trigger to release the string;

e. wherein the adjustment surface intercepts the axis of motion of the actuator at an inclined angle and f. wherein the angular relationship between the adjustment surface and the actuator axis is progressively changing along the adjustment surface.

2. The release mechanism of claim 1, further including biasing means associated with the actuator for urging the actuator into a position for maintaining the sear assembly in the closed position.

3. The release mechanism of claim 1, wherein each angular portion of the adjustment surface is a linear element.

4. The release mechanism of claim 1, wherein the adjustment surface is a continuous curved surface.

5. The release mechanism of claim 1, wherein the adjustment surface defines a cam and each jaw includes a cam follower element for engaging the cam, the actuator further including a biasing element for normally urging the actuator into engagement with the jaws and for maintaining the jaws in the closed, string retaining position, the trigger including a lever for applying a force to the actuator.

6. The release mechanism of claim 5, wherein the trigger force required to fire the release is determined by the following formula:

$$\cos C = \frac{(\cos(90 - C) \times a) + Fs((\sin(90 - C \times A) + (\sin A \times G))}{G}$$

$$\tan C = \frac{[G - FsA]}{[A + FsG]} \quad \text{when contact angle adds to load on trigger pull pin}$$

$$\tan C = \frac{[FsA + G]}{[A - FsG]} \quad \text{when contact angle subtracts to from load on trigger pull pin}$$

$$Tf = \frac{G + S}{MA}$$

where:

C=contact angle

A=two times the force on a follower

Fs=coefficient of friction static on cam and followers

G=force on trigger pull pin due to loading and Fs

S=force applied by the return spring

MA=mechanical advantage of the trigger lever

Tf=trigger force required to fire the release.

7. The release mechanism of claim 1, wherein the adjustment surface of the actuator is proportionally configured such that an incremental change in position results in an incremental change in trigger force.

8. A bow string release mechanism having a sear assembly movable between a closed, string retaining position and an opened string releasing position, an actuator associated with the sear assembly in the closed position, the actuator responsive to a movable trigger to disengage the sear assembly and permit the sear assembly to move from the closed position to the opened, string releasing position, the sear assembly comprising:

a. a support element;

b. a pair of opposed jaws having a string retaining member and mounted on the support element for pivotal movement with at least one jaw pivoting between the opened and closed positions;

c. each pivoting jaw including an actuator engaging portion, whereby the jaws are retained in the closed position when engaged by the actuator and are free to move to the opened position when not engaged by the actuator; and d. the actuator further including a jaw engaging adjustment surface selectively movable into and out of contact with the jaws in response to movement of the actuator by the trigger, the adjustment surface being positionally adjustable for varying the required force to be applied on the trigger to release the string;

e. wherein the adjustment surface intercepts the axis of motion of the actuator at an inclined angle;

f. wherein a plurality of angular surfaces on the adjustment surface establishes specific relationships between the adjustment surface and the force required to operate the trigger.

9. A bow string release mechanism having a sear assembly movable between a closed, string retaining position and an opened string releasing position, an actuator associated with the sear assembly for selectively engaging and maintaining the sear assembly in the closed position, the actuator responsive to a movable trigger to disengage the sear assembly and permit the sear assembly to move from the closed position to the opened, string releasing position, the sear assembly comprising:

a. a support element;

b. a pair of opposed jaws mounted on the support element for pivotal movement into and out of abutting engagement with one another, each jaw having opposite outer ends, a forward end of the jaws including a string retaining notch which is closed for holding a string when the jaws are in abutting engagement and which is opened for releasing the string when the jaws are separated;

c. a rearward end of each jaw adapted for receiving the actuator for holding the jaws in the abutting, closed position;

d. the pivot point of each jaw being positioned intermediately of the opposite outer ends;

e. each jaw having a string receptive notch intermediately of the forward end of the jaw and the pivot point; and f. the actuator having a jaw engaging adjustment surface which is selectively movable into and out of contact with the jaw in response to actuation of the actuator by the trigger, the adjustment surface being positionally adjustable relative to the jaw for calibrating the force required to release the string by actuation through the trigger, the adjustment surface being proportional to trigger movement such that an incremental change in position results in an incremental change in trigger force, g. the adjustment surface intercepting the axis motion of the actuator at an inclined surface and wherein the angular relationship between the adjustment surface and the actuator axis is progressively changing along the adjustment surface.

10. The release mechanism of claim 9, wherein:

a. the actuator further includes a stem extending outwardly towards the trigger;

b. the trigger includes a through channel adapted for receiving the actuator stem, the through channel having outer edges disposed in axially spaced apart relationship along the axis of the actuator stem, Whereby the trigger is adapted for rocking on the stem; and c. a trigger engagement element is located on the stem, whereby the trigger is adapted for rocking on the stem.

11. The release mechanism of claim 10, including means for adjusting the trigger engagement element position on the stem in order to change the force required to operate the trigger in order to release the string.

12. A bow string release mechanism having a sear assembly movable between a closed, string retaining position and an opened string releasing position, an actuator associated with the sear assembly for selectively engaging and maintaining the sear assembly in the closed position, the actuator responsive to a movable trigger to disengage the sear assembly and permit the sear assembly to move from the closed position to the opened, string releasing position, the sear assembly comprising:

a. a support element;

b. a pair of opposed jaws mounted on the support element for pivotal movement into and out of abutting engagement with one another, each jaw having opposite outer ends, a forward end of the jaws including a string retaining notch which is closed for holding a string when the jaws are in abutting engagement and which is opened for releasing the string when the jaws are separated;

c. a rearward end of each jaw adapted for receiving the actuator for holding the jaws in the abutting, closed position;

d. the pivot point of each jaw being positioned intermediately of the opposite outer ends;

e. each jaw having a string receptive notch intermediately of the forward end of the jaw and the pivot point;

f. the actuator having a jaw engaging adjustment surface which is selectively movable into and out of contact with the jaw in response to actuation of the actuator by the trigger, the adjustment surface being positionally adjustable relative to the jaw for calibrating the force required to release the string by actuation through the trigger, the adjustment surface being proportional to trigger movement such that an incremental change in position results in an incremental change in trigger force;

g. the adjustment surface intercepting the axis motion of the actuator at an inclined angle and wherein the angular relationship between the adjustment surface and the actuator axis is progressively changing along the length of the adjustment surface;

h. the actuator further including a stem extending outwardly from the support element;

i. the trigger including a through channel adapted for receiving the actuator shaft, the through channel having opposite outer edges disposed in axially spaced apart relationship along the axis of the actuator shaft, whereby the trigger is adapted for rocking on the shaft; and j. a trigger engaging element on the shaft, whereby rocking of the trigger is translated into axial movement of the shaft.

13. The release mechanism of claim 12, wherein each angular portion of the adjustment surface is a linear element.

14. The release mechanism of claim 12, wherein the adjustment surface is a continuous curved surface.

15. The release mechanism of claim 12, wherein the adjustment surface defines a cam and each jaw includes a cam follower element for engaging the cam, the actuator further including a biasing element for normally urging the actuator into engagement with the jaws and for maintaining the jaws in the closed, string retaining position, the trigger including a lever for applying a force to the actuator.

16. The release mechanism of claim 15, wherein the trigger force required to fire the release is determined by the following formula:

$$\cos C = \frac{(\cos(90 - C) \times a) + Fs((\sin(90 - C \times A) + (\sin A \times G))}{G}$$

$$\tan C = \frac{[G - FsA]}{[A + FsG]}$$ when contact angle adds to load on trigger pull pin $$\tan C = \frac{[FsA + G]}{[A - FsG]}$$ when contact angle subtracts to from load on trigger pull pin $$Tf = \frac{G + S}{MA}$$

where:

C=contact angle

A=two times the force on a follower

Fs=coefficient of friction static on cam and followers

G=force on trigger pull pin due to loading and Fs

S=force applied by the return spring

MA=mechanical advantage of the trigger lever

Tf=trigger force required to fire the release.

* * * * *